US012454396B2

(12) United States Patent
Brozell

(10) Patent No.: US 12,454,396 B2
(45) Date of Patent: Oct. 28, 2025

(54) MOLD-MATERIAL FLIP-TOP TAMPER EVIDENT CLOSURE

(71) Applicant: Mold-Rite Plastics, LLC, Twinsburg, OH (US)

(72) Inventor: Leonora Brozell, Maumee, OH (US)

(73) Assignee: Mold-Rite Plastics, LLC, Twinsburg, OH (US)

( * ) Notice: Subject to any disclaimer, the term of this patent is extended or adjusted under 35 U.S.C. 154(b) by 306 days.

(21) Appl. No.: 18/312,676

(22) Filed: May 5, 2023

(65) Prior Publication Data

US 2023/0356897 A1 Nov. 9, 2023

Related U.S. Application Data

(60) Provisional application No. 63/338,604, filed on May 5, 2022.

(51) Int. Cl.
*B65D 47/36* (2006.01)
*B65D 47/08* (2006.01)

(52) U.S. Cl.
CPC ..... *B65D 47/36* (2013.01); *B65D 47/0804* (2013.01); *B65D 2251/20* (2013.01); *B65D 2401/35* (2020.05)

(58) Field of Classification Search
CPC ..... B65D 47/36; B65D 47/0804; B65D 2401/35; B65D 2251/20
USPC ..... 222/83, 153.06, 541.6, 541.5, 541.1; 215/251, 258; 220/810, 255.1; 221/302
See application file for complete search history.

(56) References Cited

U.S. PATENT DOCUMENTS 4,059,201 A * 11/1977 Foster ..... B65D 51/20 220/267
4,274,563 A * 6/1981 Otterson ..... B65D 17/404 222/541.6
4,610,371 A * 9/1986 Karkiewicz ..... B65D 47/0838 215/237
5,119,964 A * 6/1992 Witt ..... B65D 51/20 215/232
5,147,054 A * 9/1992 Pehr ..... B65D 51/20 215/253
5,207,783 A * 5/1993 Burton ..... B65D 41/3442 215/256
5,636,771 A * 6/1997 Gordon ..... B65D 47/10 222/541.9
5,938,054 A * 8/1999 Loader ..... B65D 50/061 215/206

(Continued)

FOREIGN PATENT DOCUMENTS

WO 2014081413 A1 5/2014

*Primary Examiner* — Paul R Durand
*Assistant Examiner* — Michael J. Melaragno
(74) *Attorney, Agent, or Firm* — Faegre Drinker Biddle & Reath LLP

(57) ABSTRACT

A closure for use with a container, the closure including a cap assembly with a lower cap configured to attach to a neck of the container. A flip-top reclosable lid is hingedly attached to the cap assembly. The hinge permitting the lid to be pivoted open and closed relative to the cap assembly. A plurality of frangible spokes extend between and are integrally molded to the flip-top lid and the cap assembly. The spokes are spaced about a periphery of the flip-top lid and configured to break when the lid is first opened thereby providing a visual indication that the closure has been opened.

21 Claims, 12 Drawing Sheets

(56) References Cited

U.S. PATENT DOCUMENTS 6,179,147 B1 * 1/2001 Mogard ..... B65D 47/103 222/541.9
6,464,096 B2 * 10/2002 Adams ..... B65D 47/103 229/125.05
6,772,904 B1 * 8/2004 Gilliam ..... B65D 23/102 220/675
7,413,097 B1 * 8/2008 Adams ..... B65D 47/103 229/125.05
7,549,547 B2 * 6/2009 Herr ..... B65D 55/022 215/351
7,584,842 B2 * 9/2009 Neumeyer ..... B65D 51/2835 215/DIG. 8
7,832,580 B2 * 11/2010 Jackman ..... B65D 51/20 215/349
8,113,374 B2 * 2/2012 Steiger ..... B65D 47/0809 220/258.2
8,695,842 B2 * 4/2014 Gonzalez Sanchez ..... B65D 51/007 215/253
9,138,111 B2 * 9/2015 Crudge ..... B65D 47/0804
2002/0079339 A1 * 6/2002 Sheffler ..... B65D 47/36 222/548
2003/0089746 A1 * 5/2003 Odet ..... B65D 47/148 215/254
2008/0093374 A1 * 4/2008 Martins ..... B65D 47/0804 221/63
2014/0217098 A1 * 8/2014 Daggett ..... B65D 47/10 220/254.1
2014/0367400 A1 * 12/2014 Crudge ..... A47K 10/38 221/63
2015/0367998 A1 * 12/2015 Daggett ..... B65D 47/2006 220/810
2015/0368002 A1 * 12/2015 Stevens ..... B65D 43/22 220/315
2015/0368011 A1 * 12/2015 Groubert ..... B65D 47/0804 220/200
2021/0039843 A1 * 2/2021 Kouba ..... B65D 43/169
2021/0101722 A1 * 4/2021 Migas ..... B65D 41/465
2021/0371166 A1 * 12/2021 Peterson ..... B65D 11/02
2023/0356897 A1 * 11/2023 Brozell ..... B65D 47/0804

* cited by examiner

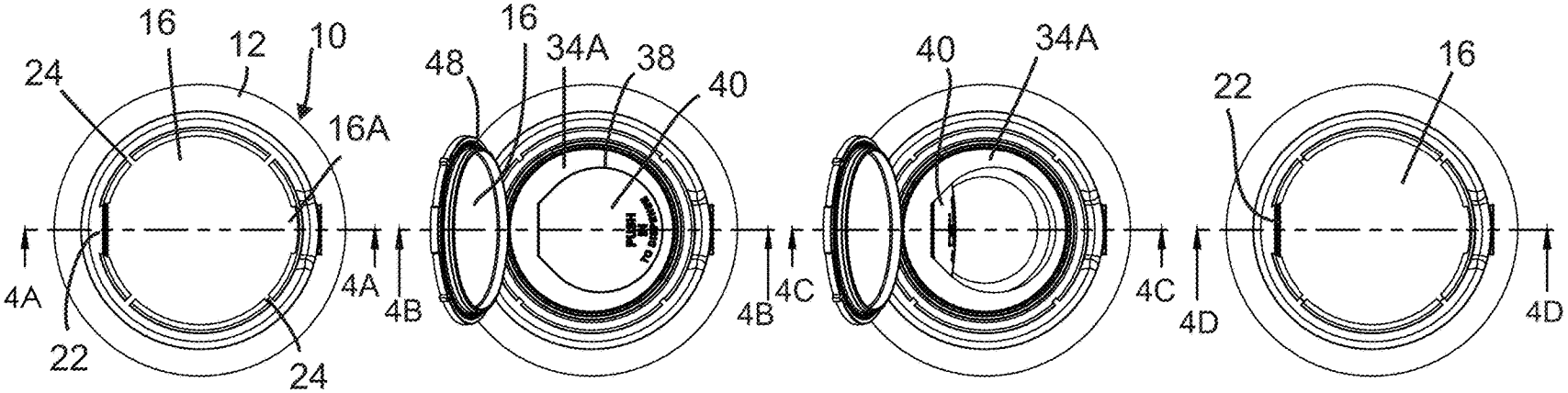
FIG. 3A
FIG. 3B
FIG. 3C
FIG. 3D
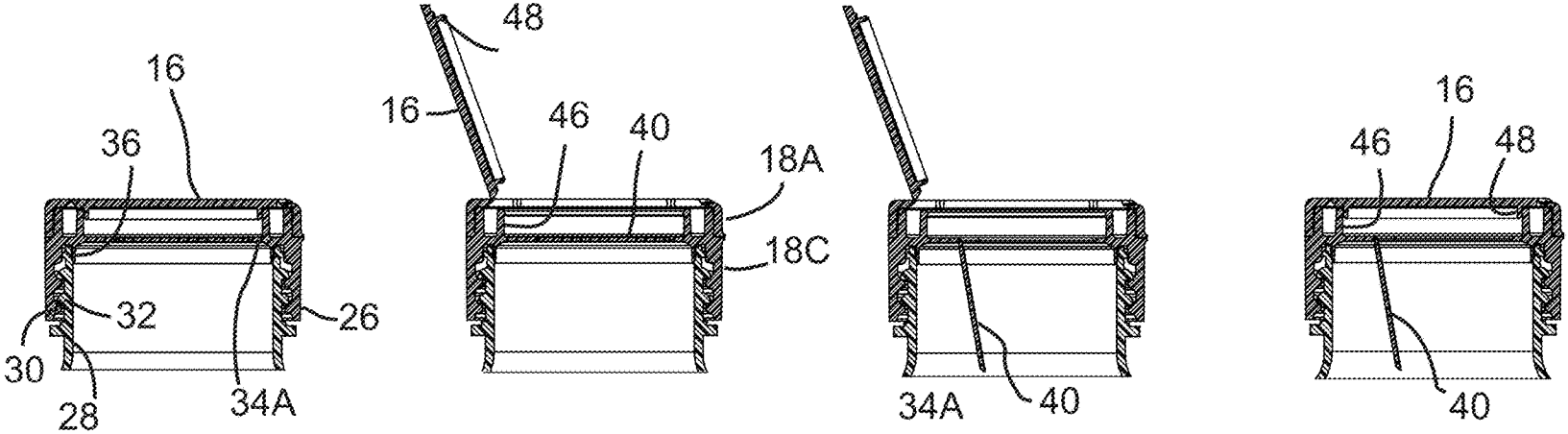
FIG. 4A
FIG. 4B
FIG. 4C
FIG. 4D

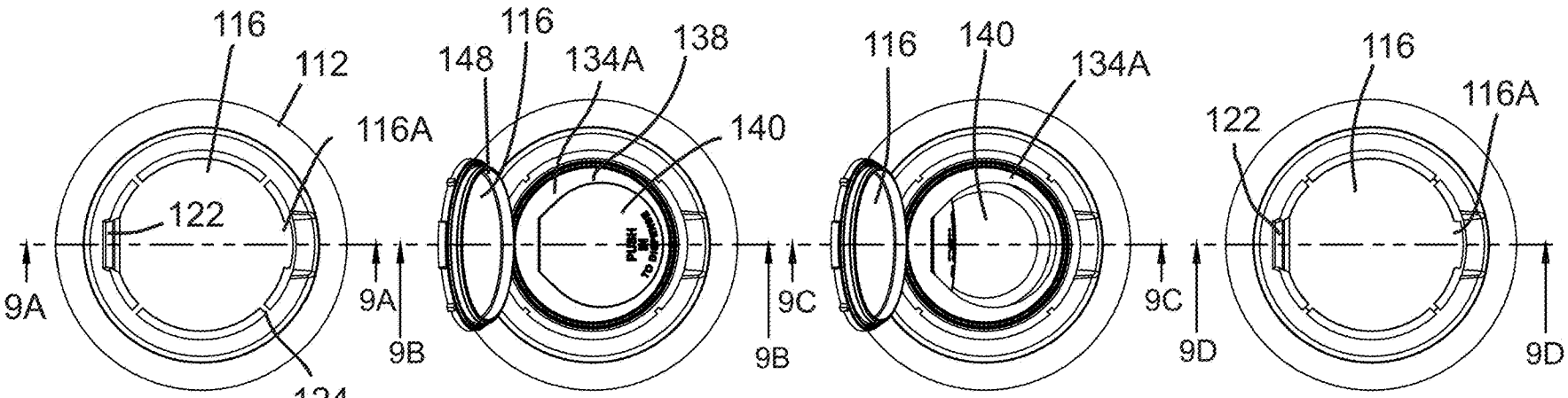
FIG. 8A
FIG. 8B
FIG. 8C
FIG. 8D
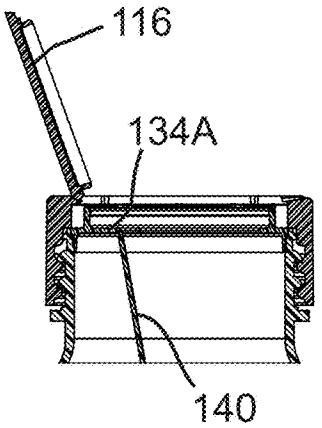
FIG. 9C
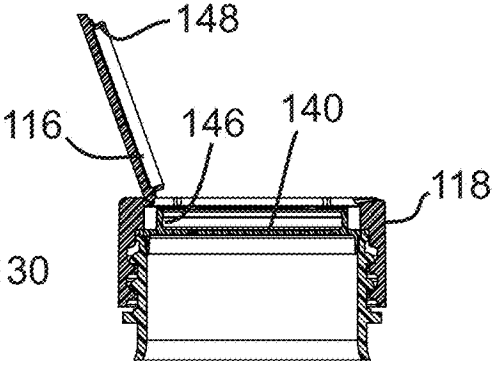
FIG. 9B
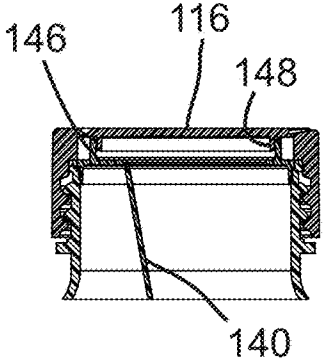
FIG. 9D
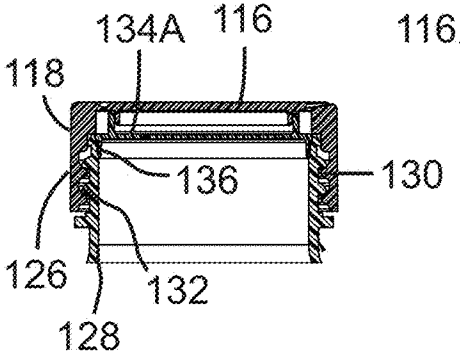
FIG. 9A

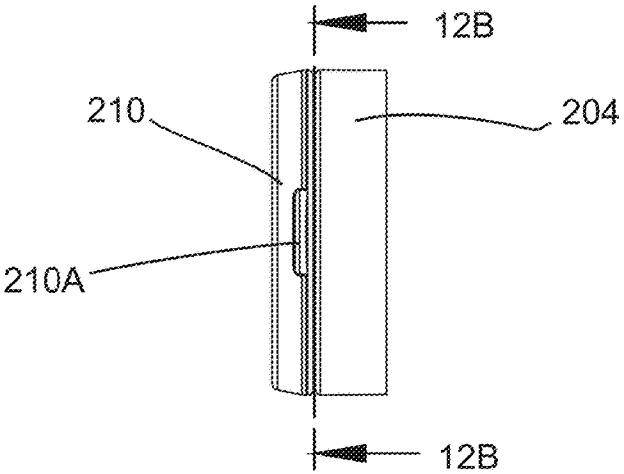
FIG. 12C
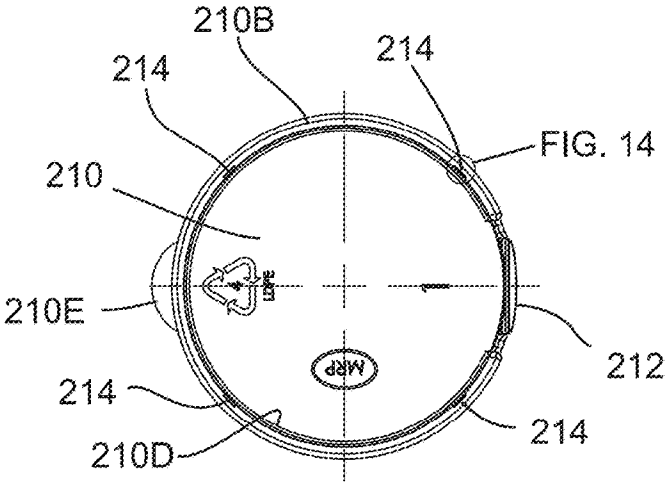
FIG. 12B
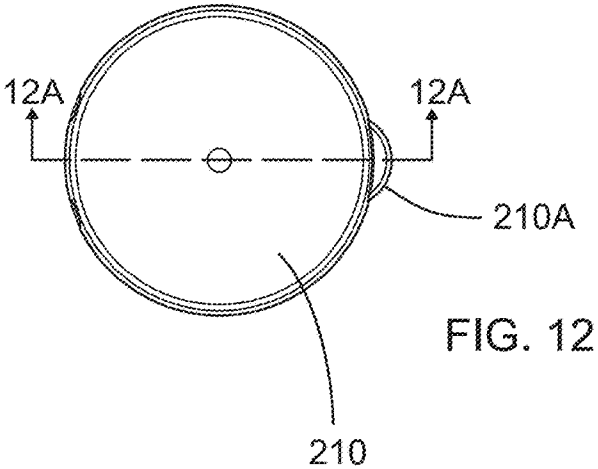
FIG. 12
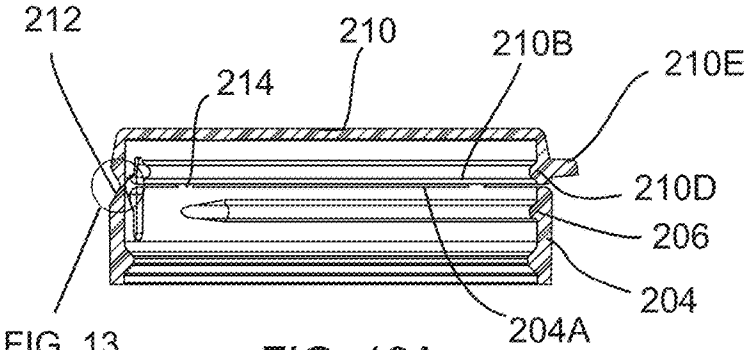
FIG. 12A
FIG. 13

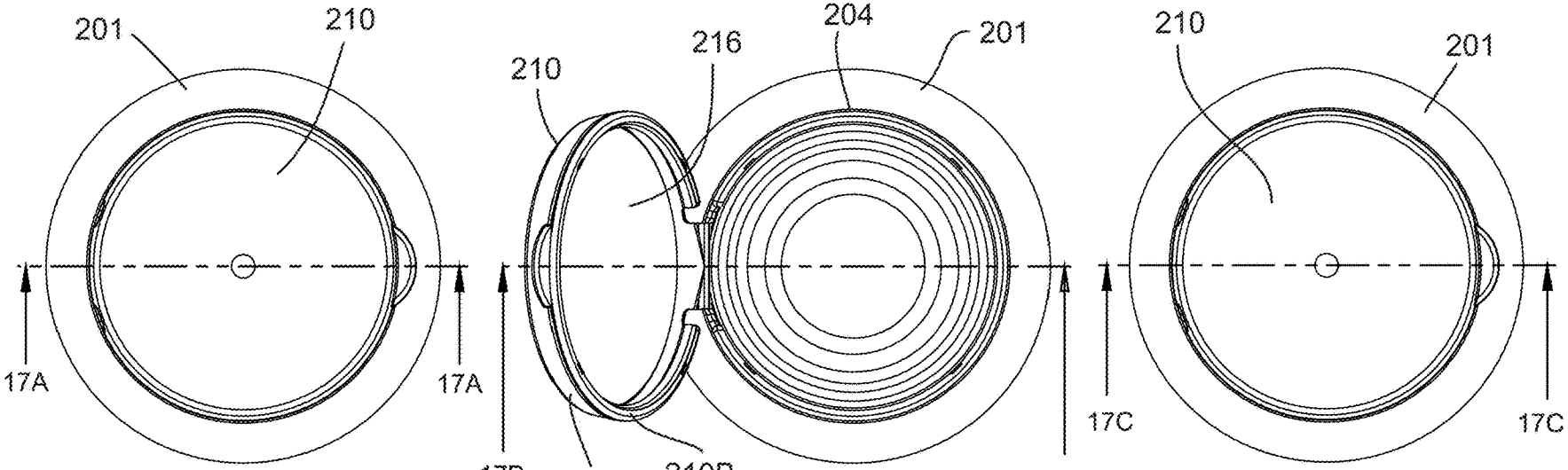
FIG. 16A
FIG. 16B
FIG. 16C
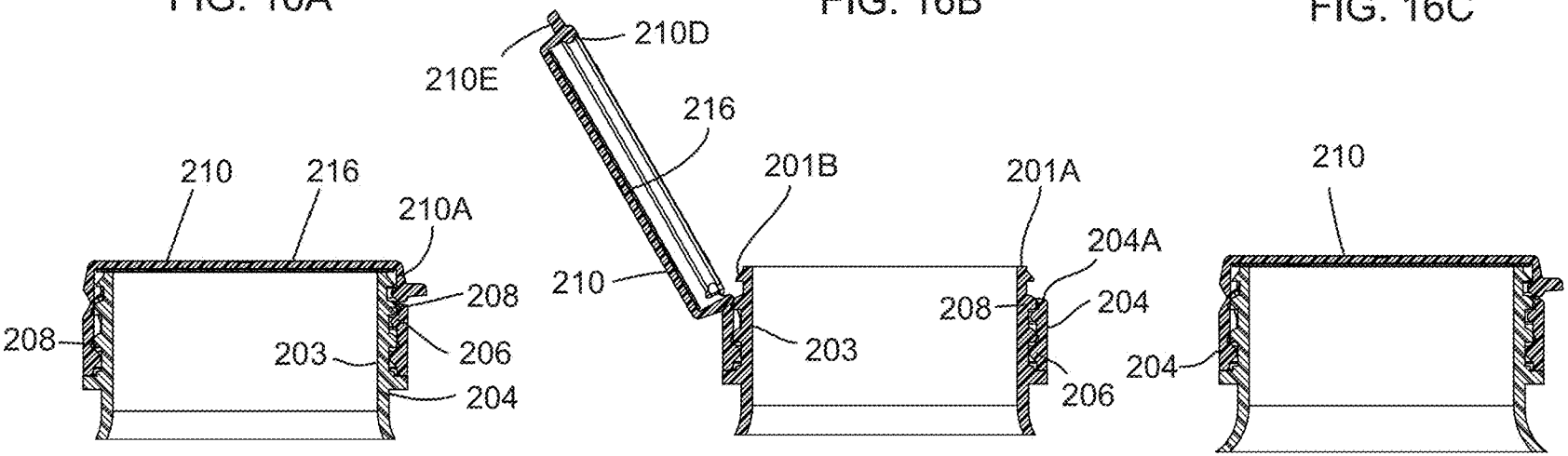
FIG. 17A
FIG. 17B
FIG. 17C

MOLD-MATERIAL FLIP-TOP TAMPER EVIDENT CLOSURE

RELATED APPLICATION

This application is related to and claims priority from U.S. Provisional Application 63/338,604 filed May 5, 2022, the disclosure of which is incorporated herein by reference in its entirety.

FIELD OF THE INVENTION

The present invention relates to a closure for a container and, more particularly, to a tamper evident closure made from mono material and attachable to and non-removable from a container.

BACKGROUND

Over the years measures have been incorporated, and in some cases imposed, to protect food, nutrient and medicine containers from tampering after a product is placed in those containers. The most well-known mechanism is the tamper-evident connection between a closure (cap) and a container. The most common type of such tamper-evidence system is a security ring that engages with and locks onto a rim of a container neck and is connected to the closure by frangible fingers. Twisting of the closure relative to the container causes the fingers to sever or break permitting the closure to be removed while leaving the ring on the container, thus providing visual evidence that the closure was opened.

Another type of tamper-evidence device is a pull-off seal that is adhered to the rim of the container. A user must tear off the seal before being able to access the contents of the container.

Sustainability and the need for recycling of product packaging is extremely important in today's society. Conventional bottles and closures have, for years, been made from recyclable plastic materials. However, it is quite common for the bottle and closure to be made from different materials, necessitating that the closure be separated from the bottle at the time of recycling.

Product manufacturers have recently been interested in packaging that is "mono material," that is, the container and closure are molded from the same material to encourage consumers to recycle the package as a complete unit.

Additionally, it would be beneficial that all the components of the package be manufactured so as to not be separable from one another, thereby minimizing waste. That means that for conventional packages, the closure should not be separated from the bottle/container and that there be no liner, shrink banding, or other tamper evident paraphernalia that may be separated from the package.

A need exists for an improved tamper-evident closure system.

SUMMARY

A closure for use with a container. The closure includes a cap assembly with a lower cap configured to attach to a neck of the container. A flip-top reclosable lid is hingedly attached to the cap assembly. The hinge permits the lid to be pivoted open and closed relative to the cap assembly. A plurality of frangible spokes extend between and are integrally molded to the flip-top lid and the cap assembly. The spokes are spaced about a periphery of the flip-top lid and configured to break when the lid is first opened thereby providing a visual indication that the closure has been opened.

In an embodiment, the cap assembly includes an inner closure cap located in the cap assembly and configured to prevent access through the lower cap to the container when the lower cap is attached to the container. The inner closure cap including a push-through access door that permits access to the contents of the container when the lower cap is attached to the container.

In an embodiment the cap assembly includes an upper cap attached to the lower cap through an integral molded hinge. The flip-top lid is attached to the upper cap, and the hinge on the flip-top is integrally molded to the flip-top and upper cap.

In an embodiment, the spokes extend radially outward from an edge of the lid to an inner periphery of a portion of the upper cap.

In any of the above embodiments, the lower cap includes a skirt which is configured to extend around and engage with the neck of the container.

An the inner surface of the skirt may include one or more radially inward projecting protrusions that are arranged to engage with associated protrusions on the neck of the container.

In an embodiment, the inner closure cap may include a landing extending radially inward from an outer periphery of the inner closure cap and inward from the skirt on the lower cap. A plug seal preferably projects downward from a bottom of the landing at a location spaced radially inward from the inner surface of the skirt so as to define a gap between the inner surface of the skirt and the plug seal into which the neck of the container can extend. At least a portion of the landing defines a sealing surface that extends across the opening of the neck of the container when the lower cap is attached to the container.

A portion of the sealing surface may include a line of weakening in the thickness of the landing. The line of weakening defines the access door in the sealing surface such that when the line of weakening is severed, the access door can be pushed inward thereby providing an opening through the sealing surface and into the container when the lower cap is attached to the container.

The line of weakening preferably does not completely encompass or encircle the access door, thus retaining or leaving a non-weakened portion connecting the access door to the sealing surface and functioning as a hinge connecting the access door to the sealing surface.

In an embodiment, the landing includes an outer rim projecting upward from a top of the landing that is configured to engage with an inner surface of a downwardly extending skirt on the upper cap so as to securely fasten the upper cap to the lower cap.

Preferably an inner rim projects upward from the top of the landing at a location radially inward from the outer rim. The inner rim is configured to removably engage with a ring that extends down from a bottom of the flip-top lid, the engagement permitting the flip-top lid to be releasably closed with respect to the upper cap.

In an embodiment, the inner closure cap is separate from the lower cap. The inner closure cap is configured to snap onto the neck of the closure. In this embodiment, the inner closure cap preferably includes a landing extending radially inward from an outer periphery of the inner closure cap and inward from the skirt on the lower cap. A plug seal projects downward from a bottom of the landing at a location spaced radially inward from the inner surface of the skirt so as to define a gap between the inner surface of the skirt and the plug seal into which the neck of the container can extend. At least a portion of the landing defines a sealing surface that extends across the opening of the neck of the container when the lower cap is attached to the container. A portion of the sealing surface includes a line of weakening in the thickness of the landing that defines the access door in the sealing surface such that when the line of weakening is severed, the access door can be pushed inward thereby providing an opening through the sealing surface and into the container when the lower cap is attached to the container. The line of weakening preferably does not completely encompass the access door, thus retaining a non-weakened portion of the sealing surface to function as a hinge connecting the access door to the sealing surface.

In this embodiment, an inner rim projects upward from the top of the landing and is configured to removably engage with a ring that extends down from the bottom of the flip-top lid. The engagement between the ring and the inner rim provides a releasable closure of the flip-top lid to the inner closure cap.

In an embodiment, the lower cap includes a skirt that engages with a neck of a container when the cap assembly is mounted to the container. The hinge of the flip-top lid is integrally molded to the flip-top lid and the lower cap skirt. The lid includes a lid rim that extends downward from a lid top and the lid rim includes one or more inner protrusions that are configured to engage with a lip on the container neck when the closure is attached to a container.

In this embodiment, the frangible spokes are molded integrally with and are located between a lower edge the lid rim and an upper edge of the skirt such that the spokes extend substantially vertically.

Preferably there are at least four spokes spaced apart from one another, with two spokes being positioned at approximately 45 degrees on either side of the hinge.

The lid may include a backing liner on a portion of its inner surface that is made from foamed polyethylene.

In an embodiment, the skirt of the cap assembly has a height that is configured, when attached to a container, to result in an upper rim of the neck of the container extending upward past an upper edge of the skirt so that the inner protrusions on the lid can engage with a lip on an outer surface of the neck.

A container and closure assembly is disclosed which includes a container having a body portion and a cylindrical neck extending upward from the body portion, the neck providing access to an interior cavity in the body portion. A closure according to any of the embodiments is attached to the container and provides restricted access to the interior cavity.

The foregoing embodiments should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

FIGS. 3A-3D are top-views and FIGS. 4A-4D are cross-sectional views of the closure system of FIG. 1A illustrating the closure in different states of opening and closing.

FIG. 3A is a top-view of the closure system of FIG. 1A and FIG. 4A is a cross-sectional view of the closure system taken along lines 4A-4A in FIG. 3A showing the closure in its closed, untampered and sealed position.

FIG. 3B is a top-view of the closure system of FIG. 1B and FIG. 4B is a cross-sectional view of the closure system taken along lines 4B-4B in FIG. 3B showing the closure in its open and sealed position.

FIG. 3C is a top-view of the closure system of FIG. 1C and FIG. 4C is a cross-sectional view of the closure system taken along lines 4C-4C in FIG. 3C showing the closure in its open and unsealed position.

FIG. 3D is a top-view of the closure system of FIG. 1A and FIG. 4D is a cross-sectional view of the closure system taken along lines 4D-4D in FIG. 3D showing the closure in its closed and unsealed position.

FIGS. 8A-8D are top-views and FIGS. 9A-9D are cross-sectional views of the closure system of FIG. 5A illustrating the closure in different states of opening and closing.

FIG. 8A is a top-view of the closure system of FIG. 5A and FIG. 9A is a cross-sectional view of the closure system taken along lines 9A-9A in FIG. 8A showing the outer closure in its closed, untampered position and the inner closure in its sealed position.

FIG. 8B is a top-view of the closure system of FIG. 5B and FIG. 9B is a cross-sectional view of the closure system taken along lines 9B-9B in FIG. 8B showing the outer closure in its open position and the inner closure in its sealed position.

FIG. 8C is a top-view of the closure system of FIG. 5C and FIG. 9C is a cross-sectional view of the closure system taken along lines 9C-9C in FIG. 8C showing outer closure in its open position and the inner closure in its unsealed position.

FIG. 8D is a top-view of the closure system of FIG. 5A and FIG. 9D is a cross-sectional view of the closure system taken along lines 9D-9D in FIG. 8D showing the outer closure in its closed position and the inner closure in its unsealed position.

FIG. 12 is a top view of the closure lid of FIG. 10.

FIG. 12A is a cross-sectional view of the closure of FIG. 12 taken along lines 12A-12A in FIG. 12.

FIG. 12B is a view of the bottom of the lid of the closure of FIG. 10.

FIG. 12C is a side view of the closure of FIG. 10.

FIG. 16A is a top-view of the closure system of FIG. 10 and FIG. 17A is a cross-sectional view of the closure system taken along lines 17A-17A in FIG. 16A showing the outer closure in its closed, untampered position.

FIG. 16B is a top-view of the closure system of FIG. 10 and FIG. 17B is a cross-sectional view of the closure system taken along lines 17B-17B in FIG. 16B showing the outer closure in its open position.

FIG. 16C is a top-view of the closure system of FIG. 10 and FIG. 17C is a cross-sectional view of the closure system taken along lines 17C-17C in FIG. 16C showing outer closure in its closed, resealed position.

BRIEF DESCRIPTION OF THE EMBODIMENTS

Figure 1C:
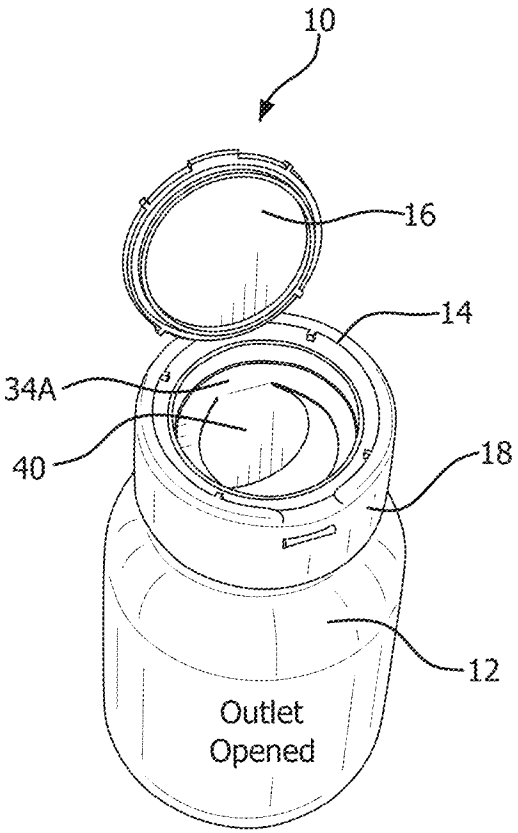
FIG. 1C is a perspective view of the closure system of FIG. 1A, with the closure in its open and unsealed position.
Figure 1B:
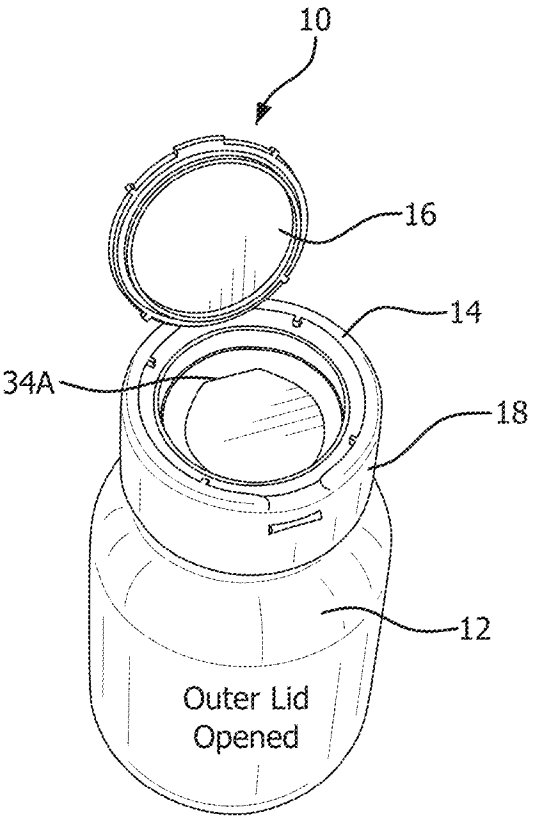
FIG. 1B is a perspective view of the closure system of FIG. 1A, with the closure in its open but sealed position.
Figure 1A:
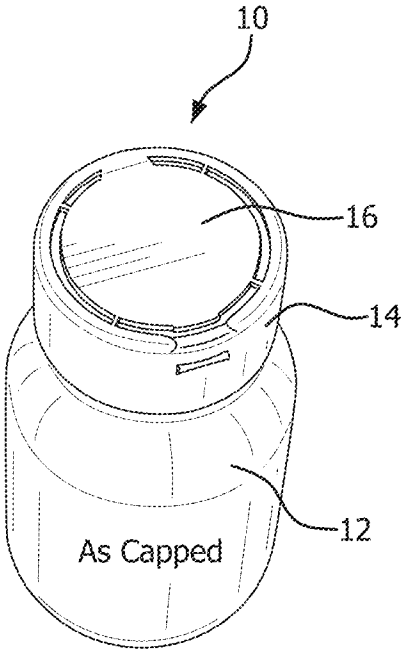
FIG. 1A is a perspective view of a tamper-evident flip-top closure system according to one embodiment of the invention on a container with the closure in its closed, untampered and sealed position.

Referring to FIGS. 1A-1C, a first embodiment of a closure system 10 according to the invention is shown. The closure system 10 is shown attached to a container 12. The closure system includes a closure 14 that has a flip-top reclosable lid 16, a cap assembly 18 and an inner closure cap having an inner sealing surface 34A with a push-through access door 40 that permits access to the contents of the container. The closure 14 has several positions or states as will be discussed in more detail below.

Figure 2C:
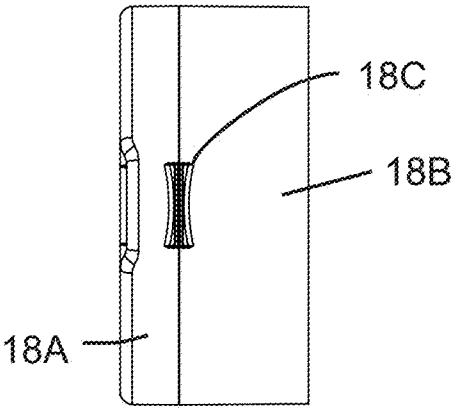
FIG. 2C is a rear view of the closure system of FIG. 2.
Figure 2:
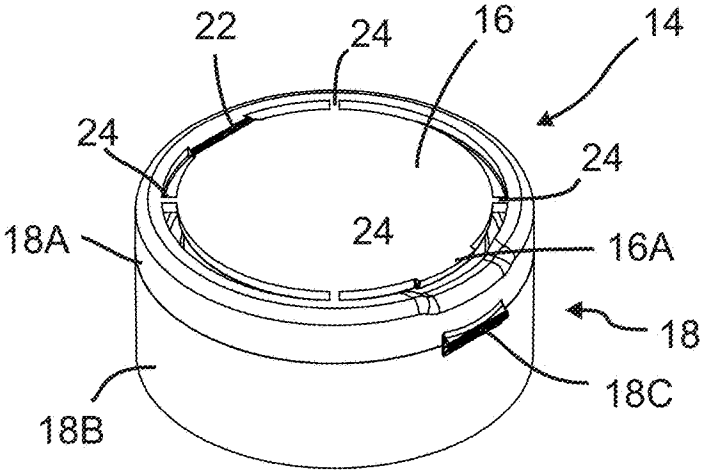
FIG. 2 is a perspective view of the closure system of FIG. 1A, with the closure in its closed, untampered and position.
Figure 2A:
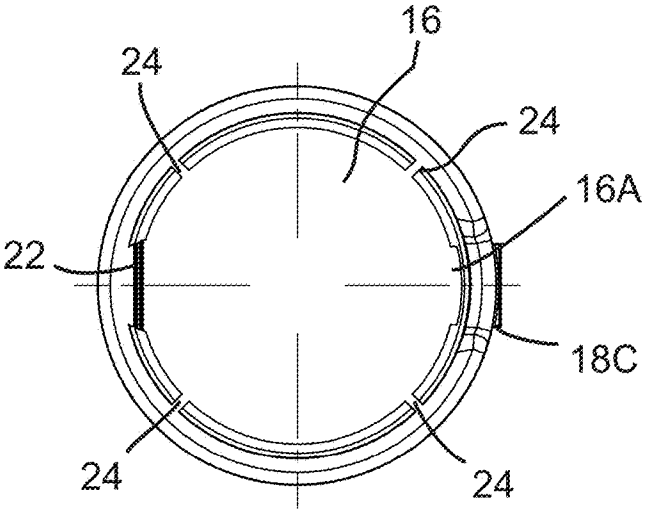
FIG. 2A is a top view of the closure system of FIG. 2.
Figure 2B:
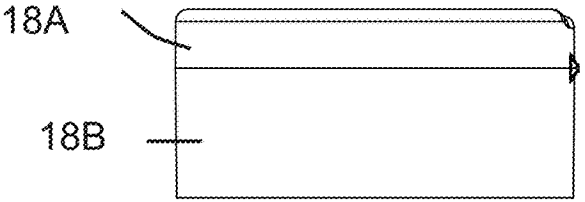
FIG. 2B is a side view of the closure system of FIG. 2.

Turning now to FIG. 2, the closure system 14 of FIG. 1A is shown with the closure 14 in its closed, untampered position. The cap assembly 18 includes an upper annular cap 18A, and a lower cap 18B which is configured to attach to the neck of the container 12 as discussed in more detail below. The upper cap 18A is attached to the lower cap 18B through an integral molded hinge 18C. As will be discussed below, when the upper cap 18A is engaged with the lower cap 18B, the two components lock together and are not readily separable.

The flip-top lid 16 is attached to the upper cap 18A of the cap assembly 18 through an integral molded hinge 22. The hinge 22 permits the lid 16 to be pivoted open and closed relative to the upper cap 18A. A plurality of thin, frangible spokes 24 integrally connect the lid 16 to the inner periphery of the upper cap 18A. The frangible spokes 24 are thin pieces of plastic molded integral with the lid 16 and the upper cap 18A. The spokes 24 are spaced around the lid 16 and extend radially outward, preferably in a horizontal direction, from the lid to a peripheral edge of the upper cap as shown. The spokes 24 are designed to break when the lid 16 is first opened. More specifically, the lid 16 includes a lip 16A that a user can grasp with the tip of their finger. When the user lifts the lip 16A of the lid 16, the force causes the spokes 24 to break. The broken spokes provide a visual indication that the closure has been opened, thus evidence of potential tampering or access with the contents of the container. As such, the connection of the lid 16 to the upper cap 18A by the spokes 124 is a tamper-evident feature of the closure.

Figure 2F:
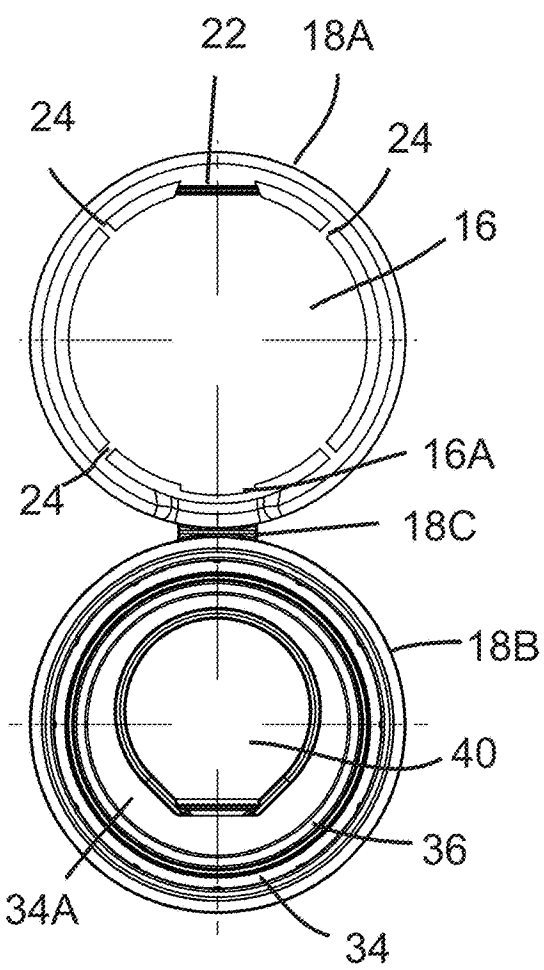
FIG. 2F is a bottom view of the closure of FIG. 2D
Figure 2E:
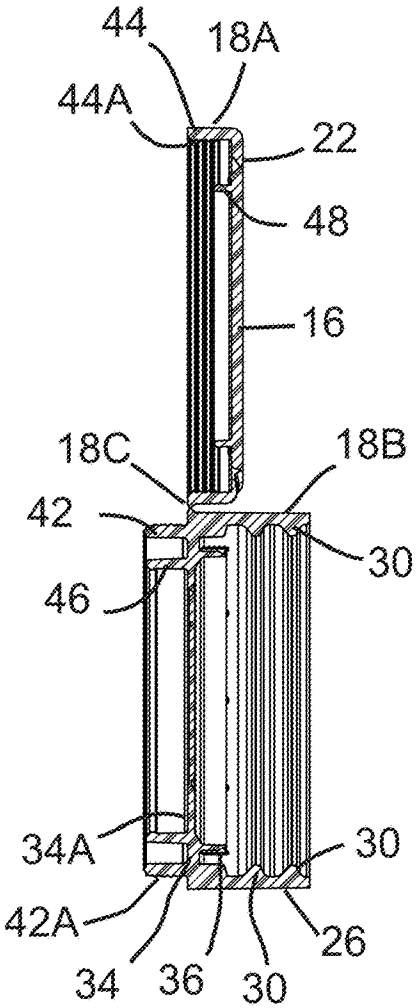
FIG. 2E is a cross-sectional view of the closure of FIG. 2D taken along lines 2E-2E of FIG. 2D.
Figure 2D:
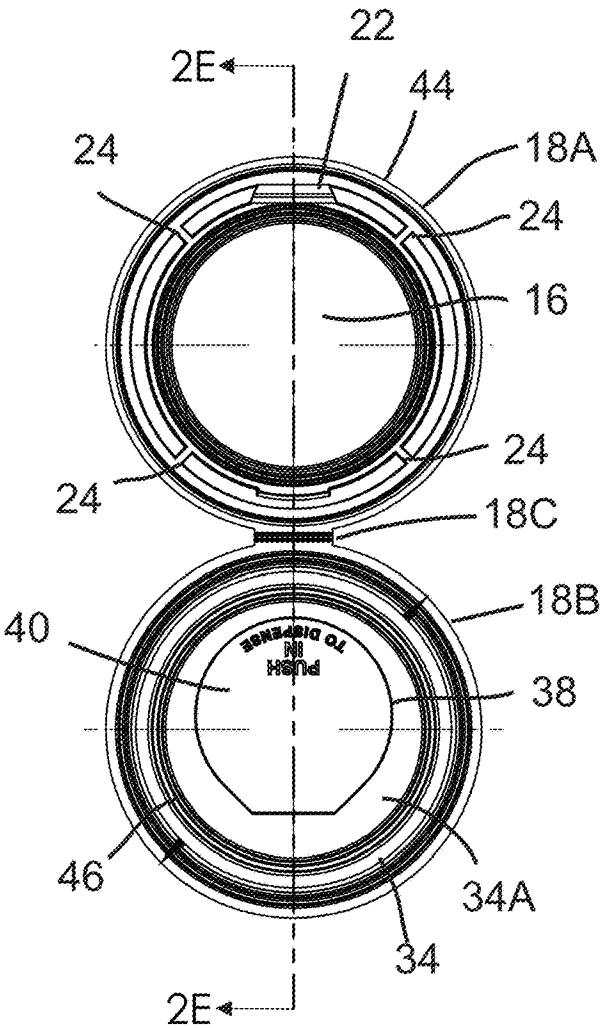
FIG. 2D is a top view of the closure system of FIG. 2, with the closure in its initial molded state with the upper rim pivoted away from the lower cap.

Referring now to FIGS. 2D-2F, the closure 14 is shown with the upper cap 18A and lower cap 18B in their initial molded state where the upper cap 18A is pivoted open relative to the lower cap 18B. Specifically, FIG. 2D is a top view of the closure 14, FIG. 2E is a cross-sectional view of the closure of FIG. 2D taken along lines 2E-2E of FIG. 2D, and FIG. 2F is a bottom view of the closure of FIG. 2D. The lower cap 18B includes a skirt 26 which is configured to extend around and engage with the neck 28 (FIG. 4A) of the container 12. More preferably, the inner surface of the skirt 26 includes one or more radially inward projecting protrusions 30 that are designed to snap over and be retained by one or more outwardly extending protrusions 32 (FIG. 4A) on the neck 28 of the container 12. The configuration of the connection between the lower cap 18B and the neck 28 of the container 12 is designed to permit the lower cap 18B to be snapped onto the neck of the container 12 and prevent easy removal. Thus, during assembly, as the lower cap 18B is pressed downwardly in the container 12, the skirt 26 will flex slightly to permit the protrusions 30 on the skirt 26 to roll over the protrusions 32 on the neck 28 and snap onto the container 12. Other forms of attachment mechanisms could be used for securing the lower cap 18B to the neck 28 of a container so as to prevent it from being removed, such as a one-way ratcheting attachment.

To provide a tight seal between the lower cap 18B and the rim of the container 12, the inner closure cap includes a landing 34 extending radially inward from the lower cap and is intended to close off the opening into the neck of the container. A plug seal 36 projects downward from the bottom of the landing 34 and is radially spaced apart from the inner surface of the skirt so as to define a gap into which the rim of the neck 28 extends (FIG. 4A). The outer surface of the plug seal 36 preferably seals securely against the inner surface of the neck at the rim.

As shown in FIGS. 2D and 2F, the landing 34 of the inner closure cap continues radially inward past the plug seal to define a sealing surface 34A that extends across the opening of the neck of the container when the lower cap 18A is attached to the container 12 (FIG. 4A). Thus, in this state, access to the container contents is prevented. A portion of the sealing surface 34A includes a line of weakening 38, such as a molded-in thinner section or a cut formed partially into the sealing surface 34A, to define an access door 40 in the sealing surface. When the line of weakening is severed, the access door 40 can be pushed inward thereby providing an opening through the sealing surface 34A and into the container. The line of weakening 38 preferably does not completely encompass the access door 40, thus permitting a non-weakened portion of the sealing surface 34A to function as a hinge connecting the access door 40 to the sealing surface.

Projecting upward from the landing 34 is an outer rim 42 that is configured to engage with an inner surface of a downwardly extending skirt 44 on the upper cap 18A. In the illustrated embodiment, the outer rim includes a series of protrusions or ridges 42A that engage or mate with corresponding protrusions 44A on the inner surface of the skirt 44 of the upper cap 18A. During assembly, the upper cap 18A is pivoted toward the lower cap 18B, until the protrusions 44A of the skirt 44 engage with the protrusions or ridges 42A of the outer rim 42, thereby locking the upper cap 18A onto the lower cap 18B and preventing easy separation. While the outer rim 42 is shown as completely circular it need not be so long as the connection between the outer rim 42 and the skirt 44 prevents easy separation.

An inner rim 46 projects upward from the landing 34 at a location radially inward from the outer rim 42. The inner rim 46 is configured to removably engage with a locking ring 48 that extends down from the bottom of the flip-top lid 16. This engagement allows the flip-top lid 16 to be locked and unlocked from the upper cap 18A. The locking can be provided by any conventional means, including press or interference fit, use of protrusions and/or detents, locking nubs or teeth, etc.

Turning now to FIGS. 3A-3D and 4A-4D, the operation of the closure system 10 will be described. These figures illustrate the closure 10 in different states of opening and closing. FIGS. 3A-3D show top-views off the closure system on a container 12 with the upper cap 18A engaged with the lower cap 18B. FIGS. 4A-4D are cross-sectional views of the closure system of FIGS. 3A-3D. More particularly, FIGS. 3A and 4A show the closure in its closed, untampered and sealed position. This is the state when the closure is locked onto the neck of the container 12 with the contents included inside the container. The flip-top 16 is secured to the upper cap 18A (i.e., the frangible spokes 24 are not broken). Thus, there is a visual indication that the contends of the container have not been accessed.

FIGS. 3B and 4B show the closure in its open and sealed position. When the user desires to access the contents of the container, the user lifts the lip 16A of the lid 16 causing the spokes 24 to break. The flip-top lid 16 pivots about its hinge 22 into its open position. The broken spokes provide a visual indication that the closure has been opened, thus evidence of potential tampering or access to the contents of the container. However, the access door 40 is still secured to the sealing surface 34A (i.e., the line of weakening 38 has not been severed.) This is a visual indication that the closure still remains sealed even though it has been opened. Thus, this is another tamper-evident feature of the closure.

When the user desires to access the contents of the container, they apply a downward force on the access door 40. This force causes the line of weakening 38 to sever and the access door to pivot inward about its hinged connection to the sealing surface 34A. FIGS. 3C and 4C show the closure in this open and unsealed position. The contents of the container can now be poured out of the container through the opening formed by the access door.

When the user wishes to close the closure system, the user simply pivots the flip-top 16 about its hinge 22 until the locking ring 48 on the bottom of the flip-top lid 16 engages with the inner rim 46 on the landing 34, thus closing the closure. FIGS. 3D and 4D show the closure in this closed and unsealed position.

The closure system 10 provides a unique system for providing tamper-evident protection for a container. In this embodiment, the upper cap 18A, the lower cap 18B, flip-top lid 16 are all molded integrally and preferably made from the same material as the container, e.g., high density polyethylene. The incorporation of the plug seal on the lower cap assures product integrity and eliminates the need for a liner.

Figure 5C:
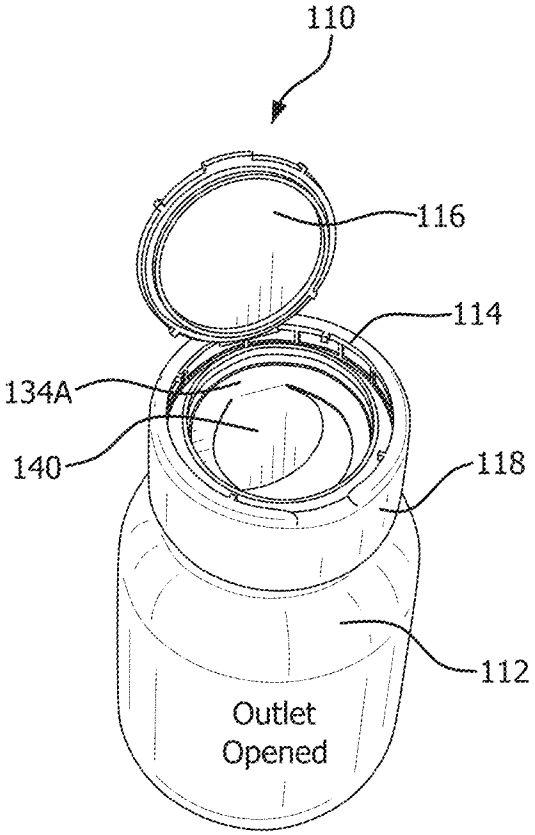
FIG. 5C is a perspective view of the closure system of FIG. 5A, with the outer closure in its open position and inner closure in its unsealed position.
Figure 5B:
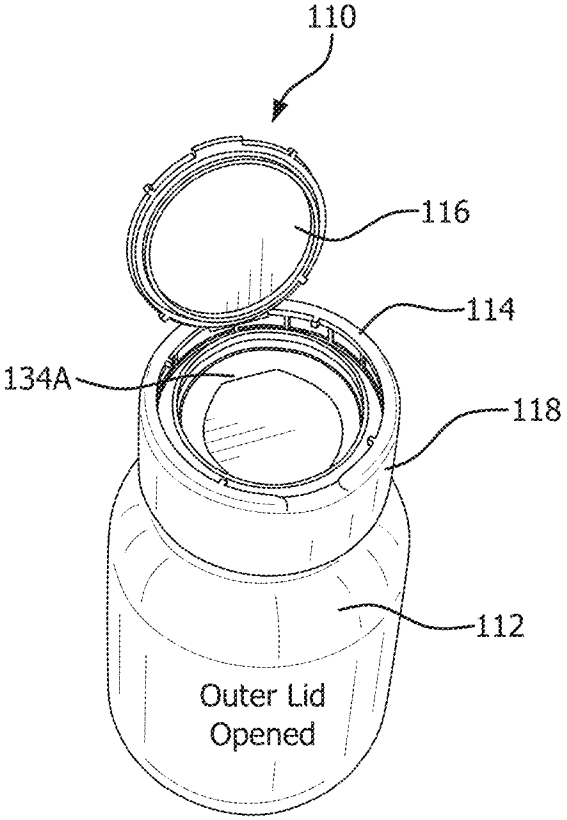
FIG. 5B is a perspective view of the closure system of FIG. 5A, with the outer closure in its open position and the inner closure in its sealed position.
Figure 5A:
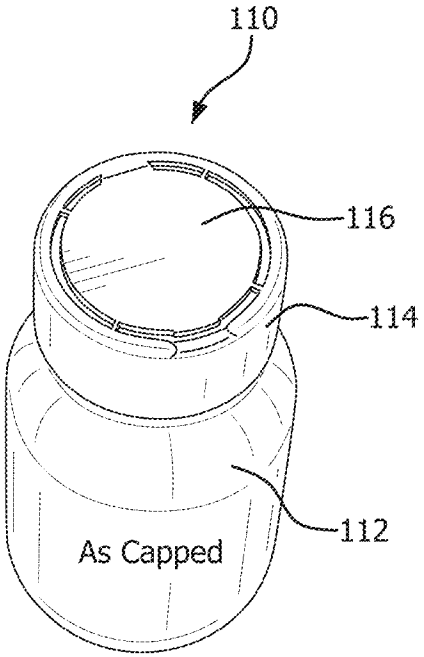
FIG. 5A is a perspective view of a two-piece tamper-evident flip-top closure system according to another embodiment of the invention on a container with the outer closure in its closed, untampered and sealed position.

Referring now to FIGS. 5A-5B, another embodiment of the closure system 110 is disclosed. In this closure system 110, the sealing surface 134 is formed as a separate component from the remainder of the closure 110. The closure system 110 otherwise operates the same as previously discussed. For the sake of simplicity, elements of this second embodiment that are similar to the first embodiment are referred to with the same reference numbers preceded by the numeral "1".

Figure 6C:
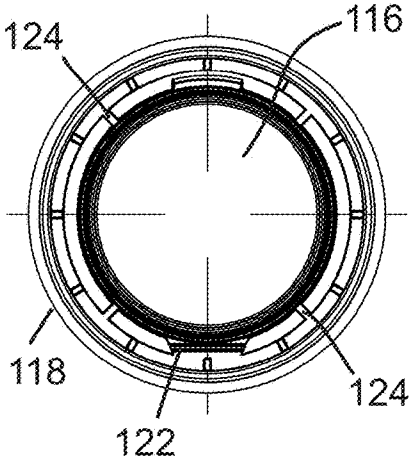
FIG. 6C is a bottom view of the outer closure of FIG. 6.
Figure 6:
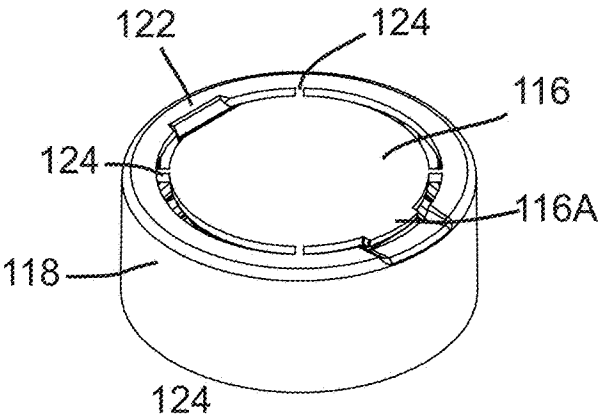
FIG. 6 is a perspective view of the outer closure of FIG. 5A, with the closure in its closed, untampered position.
Figure 6D:
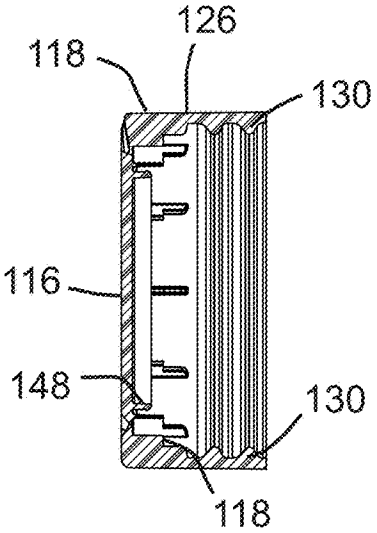
FIG. 6D is a cross-sectional view of the outer closure of FIG. 6 taken along lines 6D-6D of FIG. 6.
Figure 6A:
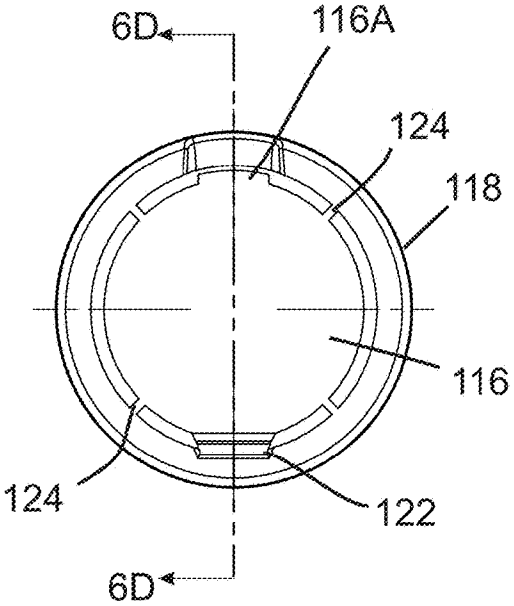
FIG. 6A is a top view of the outer closure of FIG. 6.
Figure 6B:
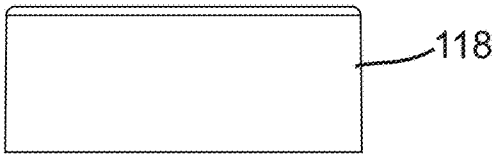
FIG. 6B is a side view of the outer closure of FIG. 6.

Turning now to FIG. 6, the closure system 114 of FIG. 5A is shown with the closure 114 in its closed, untampered position. The cap 118 is configured to attach to the neck of the container 112 as discussed in more detail below. The flip-top lid 116 is attached to the cap 118 through an integral molded hinge 122. The hinge 122 permits the lid 116 to be pivoted open and closed relative to the cap 118. A plurality of thin, frangible spokes 124 integrally connect the lid 116 to the inner periphery of the cap 18. The frangible spokes 124 are thin pieces of plastic molded from the same material as the lid 116 and the cap 118. The spokes 124 are spaced around the lid 116 and extend outward, preferably radially and horizontally, from the outer periphery of the lid 116 to an inner periphery of the cap 118. The spokes 124 are designed to break when the lid 116 is first opened. More specifically, the lid 116 includes a lip 116A that a user can grasp with the tip of their finger. When the user lifts the lip 116A of the lid 116, the force causes the spokes 124 to break. The broken spokes provide a visual indication that the closure has been opened, thus evidence of potential tampering or access with the contends of the container. As such, the connection of the lid 116 to the cap 118 by the spokes 124 is a tamper-evident feature of the closure.

The cap 118 includes a skirt 126 which is configured to extend around and engage with the neck 128 (FIG. 9A) of the container 112. More preferably, the inner diameter of the skirt 126 includes one or more radially inward projecting protrusions 130 that are designed to snap over and be retained by one or more outwardly extending protrusions 132 (FIG. 9A) on the neck 128 of the container 112. The configuration of the connection between the cap 118 and the neck 128 of the container 112 is design to permit the cap 118 to be snapped onto the neck of the container 112 and prevent easy removal. Thus, during assembly, as the cap 118 is pressed downwardly in the container 112, the skirt 126 will flex slightly to permit the protrusions 130 on the skirt 126 to roll over the protrusions 132 on the neck 128 and snap onto the container 112. Other forms of attachment mechanisms could be used for securing the cap 118 to the neck 128 of a container so as to prevent it from being removed, such as a one-way ratcheting attachment.

Figure 7B:
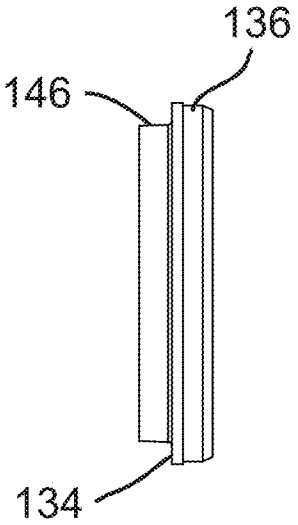
FIG. 7B is a side view of the inner closure of FIG. 7.
Figure 7:
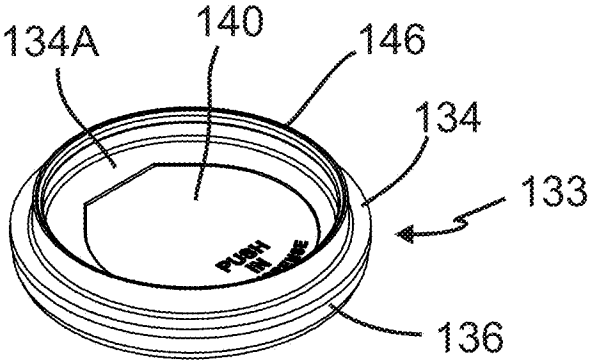
FIG. 7 is a perspective view of the inner closure of FIG. 5A, with the inner closure in its sealed position.

Referring now to FIG. 7, an inner seal 133 of the closure 110 is shown. The inner seal 133 is designed to snap only the neck of the closure. The inner seal 133 includes a landing or deck 134 extending radially inward from an outer edge. A plug seal 136 projects downward from the bottom of the landing 134 preferably at or near the outer edge. The outer surface of the plug seal 136 is configured to seal securely against the inner surface of the neck at the rim as shown in FIG. 9A.

Figure 7A:
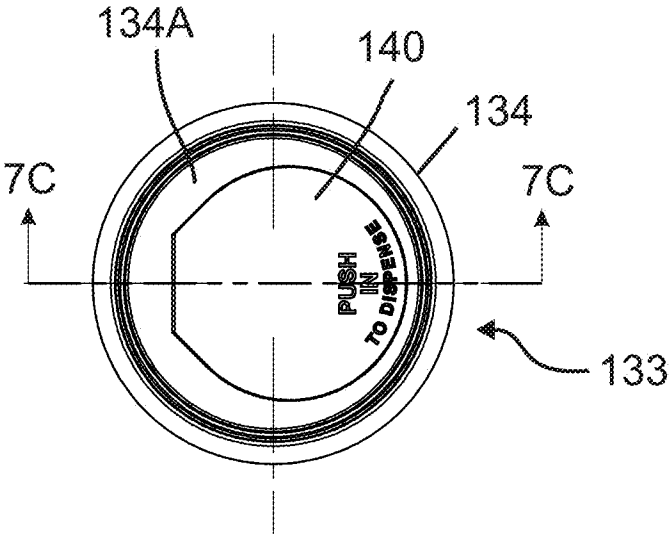
FIG. 7A is a top view of the inner closure of FIG. 7.
Figure 7C:
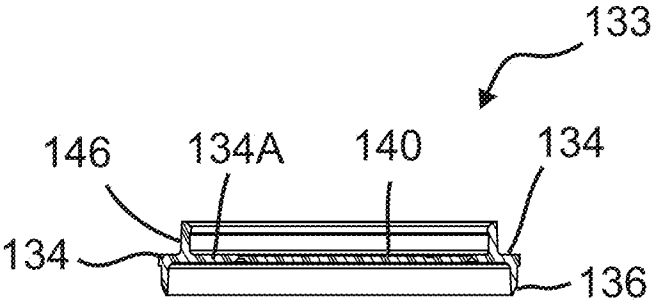
FIG. 7C is a cross-sectional view of the inner closure of FIG. 7 taken along lines 7C-7C of FIG. 7.

As shown in FIGS. 7A-7C, the landing 134 preferably continues radially inward to define a sealing surface 134A that extends across the opening of the neck of the container when the inner seal 133 is attached to the container 112 (FIG. 9A). Thus, in this state when the inner seal is attached to a container, access to the container contents is prevented. A portion of the sealing surface 134A includes a line of weakening 138, such as a molded-in thinner section or a cut formed partially into the sealing surface 134A, to define an access door 140 in the sealing surface. When the line of weakening is severed, the access door 140 provides an opening through the seal surface 134A and landing and into the container. The line of weakening 138 preferably does not completely encompass the access door 140, thus permitting a non-weakened portion of the sealing surface 134A to function as a hinge connecting the access door 140 to the sealing surface.

Projecting upward from the landing 134 is an inner rim 146. The inner rim 146 is configured to removably engage with a locking ring 148 that extends down from the bottom of the flip-top lid 116. This engagement allows the flip-top lid 116 to be locked and unlocked from the cap 118 as discussed above.

It should be readily apparent that, during assembly, the inner seal 133 is press fit or otherwise placed onto the rim of the neck of a container and then the cap 118 is pressed on top locking onto the neck of the container and thereby securing the inner seal in place. See, FIG. 9A. One of more ledges 118A preferably contact and press down on an outer rim 143B of the inner seal 133.

Turning now to FIGS. 8A-8D and 9A-9D, the operation of the closure system 110 is illustrated. The operation is essentially the same as the first embodiment of the closure 10. These figures illustrate the closure system 110 in different states of opening and closing. FIGS. 8A-8D show top-views off the closure system 110 on a container 112 with the inner seal 133 and the cap 118 attached (e.g., snapped) onto the neck 128 of the container 112. FIGS. 9A-9D are cross-sectional views of the closure system 110. More particularly, FIGS. 8A and 9A show the closure 110 in its closed, untampered and sealed position. This is the state when the closure 110 is locked onto the neck of the container 112 with the contents included inside the container. The flip-top 116 is secured to the cap 118 (i.e., the frangible spokes 124 are not broken). Thus, there is a visual indication that the contents of the container have not been accessed.

When the user desires to access the contents of the container, the user lifts the lip 116A of the lid 116 causing the spokes 124 to break. The flip-top lid 116 pivots about its hinge 122 into its open position. The broken spokes provide a visual indication that the closure has been opened, thus evidence of potential tampering or access to the contents of the container. However, the access door 140 is still secured to the sealing surface. 134A (i.e., the line of weakening 138 has not been severed.) This is a visual indication that the closure still remains sealed even though it has been opened. FIGS. 8B and 9B show the closure in this open and sealed position. Thus, this is another tamper-evident feature of the closure.

When the user desires to access the contents of the container, they apply a downward force on the access door 140. This force causes the line of weakening 138 to sever or break and the access door to pivot inward about its hinged connection to the sealing surface 134A. FIGS. 8C and 9C show the closure in this open and unsealed position. The contents of the container can now be poured out of the container through the opening formed by the access door.

When the user wishes to close the closure system 110, the user simply pivots the flip-top 116 about its hinge 122 until the locking ring 148 on the bottom of the flip-top lid 116 engages with the inner rim 146 on the landing 134, thus closing the closure. FIGS. 8D and 9D show the closure 110 in this closed and unsealed position.

The closure system 110 provides a unique system for providing tamper-evident protection for a container. In this embodiment, the cap 118 and flip-top lid 116 are molded integrally, and the inner seal 133 is molded separately. Preferably all the components of the closure system 110 are made from the same material as the container, e.g., high density polyethylene.

Figure 10:
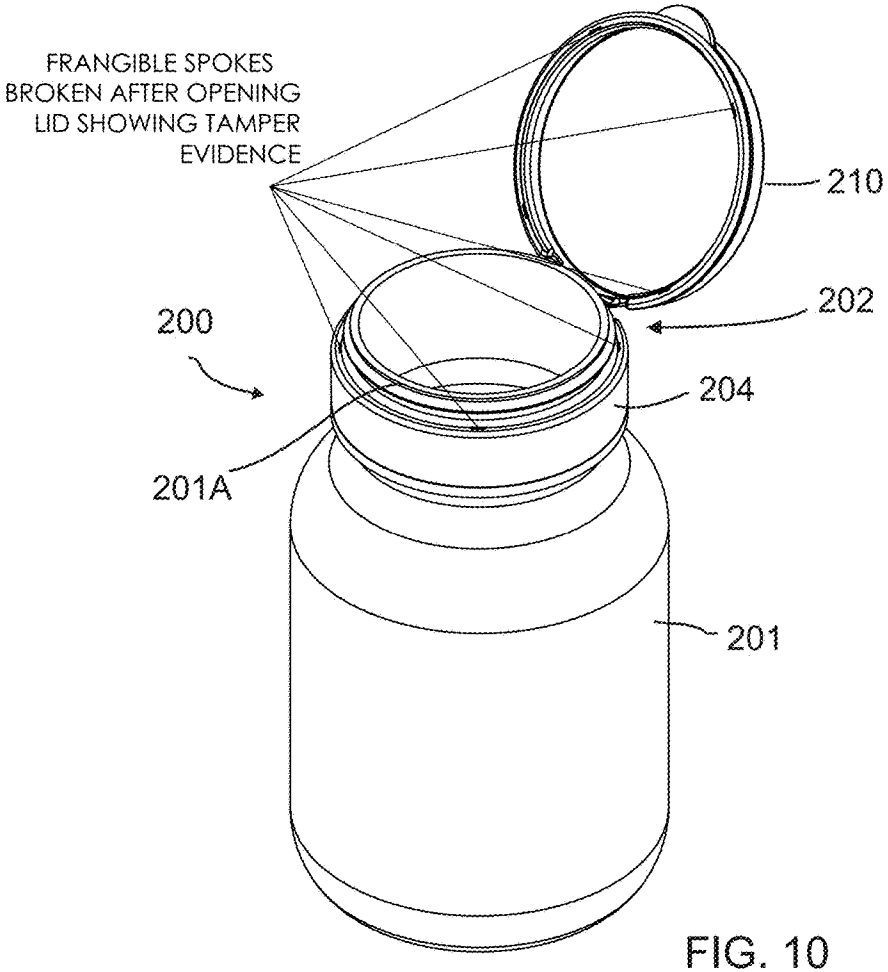
FIG. 10 is a perspective view of another embodiment of a tamper-evident flip-top closure system according to the invention on a container with the closure in its open position, unsealed position.

Referring now to FIG. 10, another tamper-evident flip-top closure system 200 is disclosed. In this embodiment, the closure or cap 202, which is shown in a perspective view on a container 201 in its opened, accessible position, includes a skirt 204 which is configured to extend around and engage with the neck 203 (FIG. 17A) of the container 202. More preferably, the inner diameter of the skirt 204 includes one or more radially inward projecting protrusions 206 that are designed to snap over and be retained by one or more outwardly extending protrusions 208 (FIG. 17A) on the neck 203 of the container 202. The configuration of the connection between the cap 202 and the neck 203 of the container 201 is designed to permit the cap 202 to be snapped onto the neck of the container 201 and prevent easy removal. Thus, during assembly, as the cap 202 is pressed downwardly in the container 201, the skirt 204 will flex slightly to permit the protrusions 206 on the skirt 204 to roll over the protrusions 208 on the neck 203 and snap onto the container 201. Other forms of attachment mechanisms could be used for securing the cap 202 to the neck 203 of a container so as to prevent it from being removed, such as a one-way ratcheting attachment.

Figure 11:
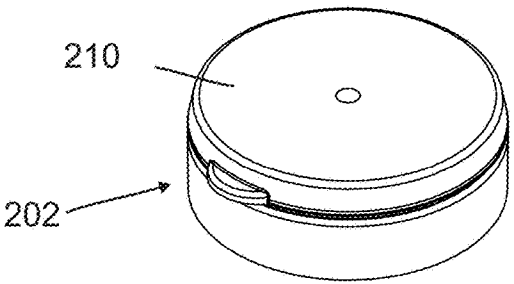
FIG. 11 is a perspective view of the closure of FIG. 10 in its closed, untampered position, not attached to a container.
Figure 11A:
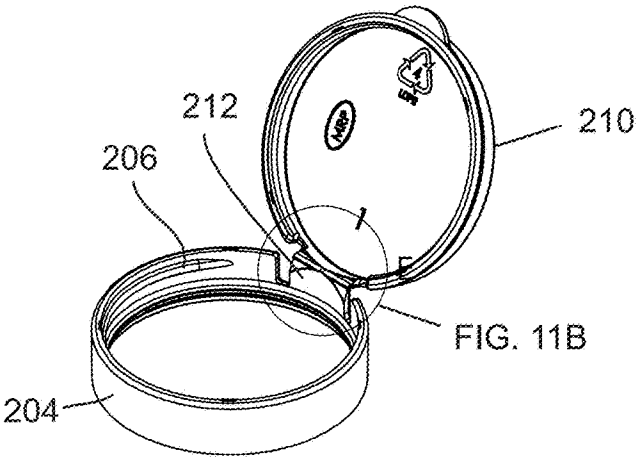
FIG. 11A is a perspective view of the closure of FIG. 10 in its open position, unsealed position.
Figure 11B:
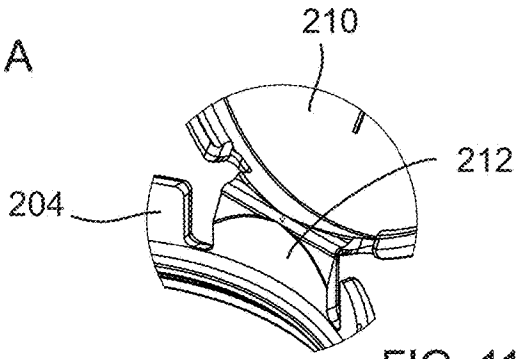
FIG. 11B is a close-up of the hinge connecting the lid to the mounting ring of the closure of FIG. 10.
Figure 13:
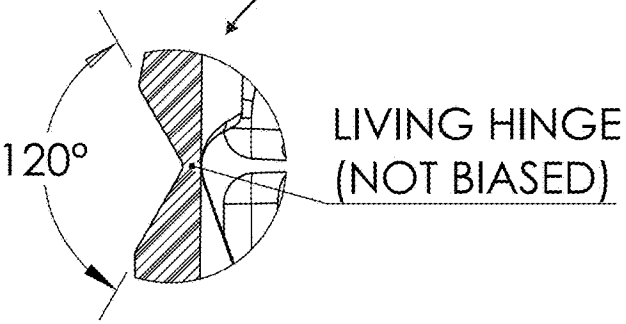
FIG. 13 is an enlarged partial view of the hinge of FIG. 12A.
Figure 15:
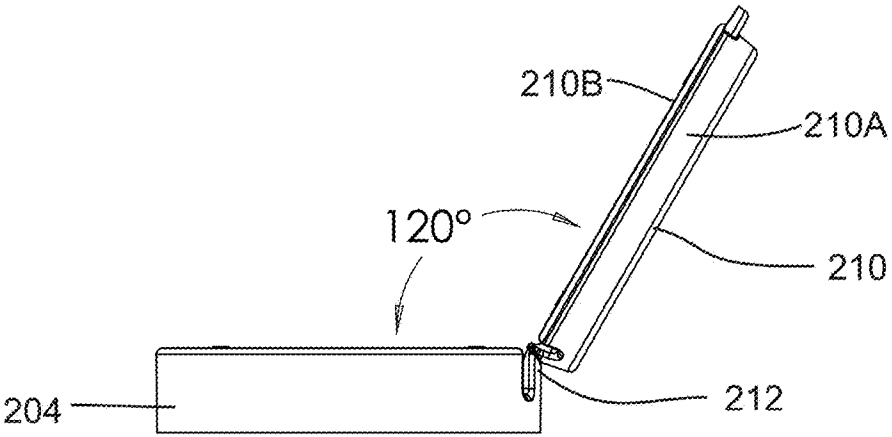
FIG. 15 is a side view of the closure of FIG. 10 in its open position.

The cap 202 includes a flip-top lid 210 that is attached to the skirt 204 through an integral molded hinge 212. The hinge 122 permits the lid 210 to be pivoted open and closed relative to the skirt 204. The lid 210 is shown in its open position in FIGS. 10 and 11A, and its closed position in FIG. 11. The hinge 212 is preferably a "living hinge". A living hinge is a thin section of integral material that connects the lid 210 to the skirt 204. The living hinge allows the lid 210 to rotate or pivot between its closed and open positions. The hinge 212 preferably has a 120 degree notch cut or molded into the outside surface (see FIG. 13) to permit the pivoting. This allows the lid to open to about 120 degrees as shown in FIG. 15. The hinge 212 is designed such that when the lid 210 is opened, the hinge is preferably configured such that it creates inherent bias when the lid is open urging it toward its closed position.

The lid 210 includes a lid rim 210A that extends downward from the lid top 210C. The lid rim 210A is aligned with the cap skirt 204 as will become apparent below. The lid rim 210A includes one or more inner protrusions 210D that are configured to engage with a lip on the container neck rim as discussed below.

In order to provide tamper-evidence, the closure 200 in this embodiment include a plurality of thin, frangible spokes or membranes 214 that integrally connect the lid 210 to the skirt 204. The frangible spokes 214 are thin pieces of plastic molded integral with a lower edge 210B of the lid rim 210A and an upper edge 204A of the skirt 204. The spokes 214 are located spaced around the lid 210 and skirt 204. The spokes 214 are designed to break when the lid 210 is first flipped opened. More specifically, the lid 210 includes a lip 210E that a user can grasp with the tip of their finger. When the user lifts the lip 210A of the lid 210, the force causes the spokes 214 to break. The broken spokes provide a visual indication that the closure has been opened, thus evidence of potential tampering or access with the contends of the container. As such, the connection of the lid 210 to the skirt 204 by the spokes 214 is a tamper-evident feature of the closure. Preferably there are four spokes 214 that are spaced 90 degrees apart from one another, with two positioned 45 degrees on either side of the hinge 212. However any number of spokes and location may be used. The spokes are formed with a thickness that is less than the thickness of the lid 210, preferably less than half the thickness.

Figure 14:
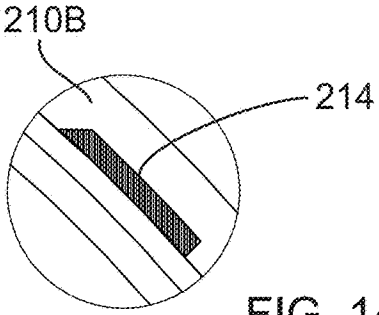
FIG. 14 is an enlarged view of the frangible spokes taken from FIG. 12B.

FIG. 14 is an enlarged view of the frangible spokes taken from FIG. 12B as a section view through the frangible spokes 214 attaching the lower edge 210B of the lid to the upper edge 204A of the skirt 204. This illustration shows that the outer side of the frangible spokes are preferably include a draft to facilitate removal from the mold (splits).

The lid 210 preferably includes a backing liner 216 on its inner surface that is made from foamed polyethylene. The liner is designed to come into contact with the top edge of the neck so as to provide a seal. The backing liner provides a product integrity seal and is designed so as not to require any special consideration depending on the container neck opening. That is, no special tooling or holding dimension to a diameter. The liner stays in the lid for recycling and, since it is mono material (e.g., PE), it is recycled as one unit, i.e., no separate of the parts is needed.

Preferably there is an inner seal across to top rim of the neck 201 that provides a second level of tamper evidence.

As shown in FIGS. 10 and 17A-17C, the skirt of the cap 204 has a height that is configured, when attached to a container 201, to result in the rim 201A of the neck of the container 201 extending upwards past the upper edge 204A of the skirt 204. The container rim 201A include one or more lips or ledges 201B that protrude radially outward. These are located so as to engage with the inner protrusions 210D on the lid 210 to secure the lid to the neck of the container (see FIGS. 17A and 17C).

Referring to FIGS. 16A-16C and 17A-17C, the closure system 200 is shown in its different stages of use. FIG. 16A is a top-view and FIG. 17A is a cross-sectional view showing the cap 202 with the lid 210 in its closed, untampered position with tamper-evident spokes unbroken.

FIG. 16B is a top-view and FIG. 17B is a cross-sectional view showing the cap 202 with the lid 210 in its open position with the tamper-evident spokes 214 broken.

FIG. 16C is a top-view and FIG. 17C is a cross-sectional view of the cap 202 showing the lid 210 in its closed position and the cap resealed.

As used herein, the term "engage" is intended to both direct physical engagement through one or more components as well as operative engagement.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

Terms such as "about" or "approximately", unless otherwise defined or restricted in the specification, should be understood to define a variance of plus or minus 5%-10% to the numerical term referred to.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

The use of directions, such as forward, rearward, top and bottom, upper and lower are with reference to the embodiments shown in the drawings and, thus, should not be taken as restrictive. Reversing or flipping the embodiments in the drawings would, of course, result in consistent reversal or flipping of the terminology.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalent.

The invention claimed is:

1. A closure for use with a container, the closure comprising a cap assembly including a lower cap configured to attach to a neck of the container;

a flip-top reclosable lid integrally molded to and hinged to the cap assembly, the hinge permitting the lid to be pivoted open and closed relative to the cap assembly; and a plurality of frangible spokes extending between and integrally molded to the flip-top lid and the cap assembly, the spokes being spaced about a periphery of the flip-top lid and configured to break when the lid is first opened thereby providing a visual indication that the closure has been opened;

wherein the cap assembly includes an inner closure cap located in the cap assembly below the lid and integrally molded to the cap assembly, the inner closure configured to prevent access through the lower cap to a container when the lower cap is attached to the container, the inner closure cap including a push-through access door that permits access to the contents of the container when the lower cap is attached to the container.

2. The closure of claim 1, wherein the cap assembly includes an upper cap attached to the lower cap through an integral molded hinge.

3. The closure of claim 2, wherein the flip-top lid is attached to the upper cap, and the hinge on the flip-top is integrally molded to the flip-top and upper cap.

4. The closure of claim 2, wherein the spokes extend radially outward from an edge of the lid to an inner periphery of a portion of the upper cap.

5. The closure of claim 1, wherein the lower cap includes a skirt which is configured to extend around and engage with the neck of the container.

6. The closure of claim 5, wherein the inner surface of the skirt includes one or more radially inward projecting protrusions that are arranged to engage with associated protrusions on the neck of the container.

7. A container and closure assembly comprising:

the container having a body portion and the cylindrical neck extending upward from the body portion, the neck providing access to an interior cavity in the body portion; and the closure according to claim 1, the closure providing restricted access to the interior cavity.

8. A closure for use with a container, the closure comprising:

a cap assembly including a lower cap configured to attach to a neck of the container;

a flip-top reclosable lid hingedly attached to the cap assembly, the hinge permitting the lid to be pivoted open and closed relative to the cap assembly; and a plurality of frangible spokes extending between and integrally molded to the flip-top lid and the cap assembly, the spokes being spaced about a periphery of the flip-top lid and configured to break when the lid is first opened thereby providing a visual indication that the closure has been opened;

wherein the cap assembly includes an inner closure cap located in the cap assembly and configured to prevent access through the lower cap to a container when the lower cap is attached to the container, the inner closure cap including a push-through access door that permits access to the contents of the container when the lower cap is attached to the container;

wherein the cap assembly includes an upper cap attached to the lower cap through an integral molded hinge; and wherein the inner closure cap includes a landing extending radially inward from an outer periphery of the inner closure cap and inward from the skirt on the lower cap, a plug seal projects downward from a bottom of the landing at a location spaced radially inward from the inner surface of the skirt so as to define a gap between the inner surface of the skirt and the plug seal into which the neck of the container can extend, wherein the landing defines a sealing surface that extends across the opening of the neck of the container when the lower cap is attached to the container.

9. The closure of claim 8, wherein a portion of the sealing surface includes a line of weakening in the thickness of the landing, the line of weakening defining the access door in the sealing surface such that when the line of weakening is severed, the access door can be pushed inward thereby providing an opening through the sealing surface and into the container when the lower cap is attached to the container.

10. The closure of claim 9, wherein the line of weakening does not completely encompass the access door, thus retaining a non-weakened portion of the sealing surface to function as a hinge connecting the access door to the sealing surface.

11. The closure of claim 8, wherein the landing includes an outer rim projecting upward from a top of the landing that is configured to engage with an inner surface of a downwardly extending skirt on the upper cap so as to securely fasten the upper cap to the lower cap.

12. The closure of claim 11, wherein an inner rim projects upward from the top of the landing at a location radially inward from the outer rim, the inner rim is configured to removably engage with a ring that extends down from a bottom of the flip-top lid, the engagement permitting the flip-top lid to be releasably closed with respect to the upper cap.

13. A closure for use with a container, the closure comprising:

a cap assembly including a lower cap configured to attach to a neck of the container;

a flip-top reclosable lid hingedly attached to the cap assembly, the hinge permitting the lid to be pivoted open and closed relative to the cap assembly; and a plurality of frangible spokes extending between and integrally molded to the flip-top lid and the cap assembly, the spokes being spaced about a periphery of the flip-top lid and configured to break when the lid is first opened thereby providing a visual indication that the closure has been opened;

wherein the cap assembly includes an inner closure cap located in the cap assembly and configured to prevent access through the lower cap to a container when the lower cap is attached to the container, the inner closure cap including a push-through access door that permits access to the contents of the container when the lower cap is attached to the container; and wherein the inner closure cap is separate from the lower cap, the inner closure cap configured to snap onto the neck of the closure.

14. The closure of claim 13, wherein the inner closure cap includes a landing extending radially inward from an outer periphery of the inner closure cap and inward from the skirt on the lower cap, a plug seal projects downward from a bottom of the landing at a location spaced radially inward from the inner surface of the skirt so as to define a gap between the inner surface of the skirt and the plug seal into which the neck of the container can extend, wherein the landing defines a sealing surface that extends across the opening of the neck of the container when the lower cap is attached to the container.

15. The closure of claim 13, wherein a portion of the sealing surface includes a line of weakening in the thickness of the landing, the line of weakening defining the access door in the sealing surface such that when the line of weakening is severed, the access door can be pushed inward thereby providing an opening through the sealing surface and into the container when the lower cap is attached to the container.

16. The closure of claim 14, wherein the line of weakening does not completely encompass the access door, thus retaining a non-weakened portion of the sealing surface to function as a hinge connecting the access door to the sealing surface.

17. The closure of claim 15, wherein an inner rim projects upward from the top of the landing, the inner rim configured to removably engage with a ring that extends down from the bottom of the flip-top lid, the engagement between the ring and the inner rim provides a releasable closure of the flip-top lid to the inner closure cap.

18. A closure for use with a container, the closure comprising:

a cap assembly including a lower cap configured to attach to a neck of the container;

a flip-top reclosable lid integrally molded to and hinged to the cap assembly, the hinge permitting the lid to be pivoted open and closed relative to the cap assembly; and a plurality of frangible spokes extending between and integrally molded to the flip-top lid and the cap assembly, the spokes being spaced about a periphery of the flip-top lid and configured to break when the lid is first opened thereby providing a visual indication that the closure has been opened;

wherein the lower cap includes a skirt that engages with the neck of the container when the cap assembly is mounted to the container, the hinge of the flip-top lid is integrally molded to the flip-top lid and the lower cap skirt, the lid including a lid rim that extends downward from a lid top, the lid rim includes one or more inner protrusions that are configured to engage with a lip on the container neck when the closure is attached to a container;

wherein the frangible spokes are molded integrally with and are located between a lower edge of the lid rim and an upper edge of the skirt such that the spokes extend substantially vertically therebetween.

19. The closure of claim 18, wherein there are at least four spokes spaced apart from one another, with two spokes being positioned at approximately 45 degrees on either side of the hinge.

20. The closure of claim 18, wherein the lid includes a backing liner on a portion of its inner surface that is made from foamed polyethylene.

21. The closure of claim 18, wherein the skirt of the cap has a height that is configured, when attached to a container, to result in an upper rim of the neck of the container extending upward past an upper edge of the skirt so that the inner protrusions on the lid can engage with a lip on an outer surface of the neck.

* * * * *